US011492831B2

(12) United States Patent
Kao et al.

(10) Patent No.: US 11,492,831 B2
(45) Date of Patent: Nov. 8, 2022

(54) ANTI-DERAILING DEVICE FOR SLIDING DOOR

(71) Applicants: EPCO ARCHITECTURE HARDWARE (TAIWAN) CORP., Taipei (TW); Eurotech Showers Inc., Laguna Hills, CA (US)

(72) Inventors: Chun-Chou Kao, Taoyuan (TW); James Simmons, Laguna Hills, CA (US)

(73) Assignees: EPCO Architecture Hardware (Taiwan) Corp., Taipei (TW); Eurotech Showers Inc., Laguna Hills, CA (US)

( * ) Notice: Subject to any disclaimer, the term of this patent is extended or adjusted under 35 U.S.C. 154(b) by 141 days.

(21) Appl. No.: 16/913,481

(22) Filed: Jun. 26, 2020

(65) Prior Publication Data

US 2021/0062562 A1 Mar. 4, 2021

(30) Foreign Application Priority Data

Aug. 29, 2019 (TW) ..... 108131054

(51) Int. Cl.
*E05D 15/06* (2006.01)
*E06B 3/02* (2006.01)

(52) U.S. Cl.
CPC ..... *E05D 15/0634* (2013.01); *E05Y 2900/114* (2013.01); *E05Y 2900/132* (2013.01); *E06B 3/02* (2013.01)

(58) Field of Classification Search
CPC ..... E05D 15/0634; E05D 15/0626
See application file for complete search history.

(56) References Cited

U.S. PATENT DOCUMENTS 1,027,156 A * 5/1912 Rumsey ..... E05D 15/0626 49/410
5,070,575 A * 12/1991 Redman ..... E05D 15/0639 16/98

(Continued)

FOREIGN PATENT DOCUMENTS

CA 2715561 A1 * 3/2011 ..... E05D 13/1276
CA 2904883 A1 * 9/2016 ..... A47K 3/34

(Continued)

OTHER PUBLICATIONS

Machine translation of CN103255972A.*

*Primary Examiner* — Marcus Menezes
(74) *Attorney, Agent, or Firm* — Muncy, Geissler, Olds & Lowe, P.C.

(57) ABSTRACT

An anti-derailing device for a sliding door, including slide rollers on upper edges of two sides of the sliding door, anti-bounce rollers below the slide rollers, rail supporting bases on a fixed door in front of the sliding door, and a rail fixed on opposite outer sides of the sliding door and the fixed door and clamped between the rollers. Each roller includes a fixed part and a first adjusting part which includes a first eccentric roller combined with the fixed part, each roller includes a fixing part and a second adjusting part which includes a second eccentric roller combined with the fixing part, and each rail supporting base includes a positioning part and a holding part for holding the rail. By adjusting positions of the rollers and without pre-machined holes, the sliding door can operate balanced and smoothly and prevent the rail from derailing.

8 Claims, 14 Drawing Sheets

(56) References Cited

U.S. PATENT DOCUMENTS

| | | | | |
|---|---|---|---|---|
| 8,407,941 | B2 * | 4/2013 | Chang | E05F 11/04 49/425 |
| 2003/0172592 | A1 * | 9/2003 | Krimmel | G09F 9/33 49/413 |
| 2004/0098831 | A1 * | 5/2004 | Elmer | E05D 15/063 16/89 |
| 2009/0000204 | A1 * | 1/2009 | Chang | E05D 15/0634 49/425 |
| 2021/0131157 | A1 * | 5/2021 | Minter | E05D 15/0669 |

FOREIGN PATENT DOCUMENTS

| | | | | | |
|---|---|---|---|---|---|
| CN | 103255972 | A | * | 5/2013 | E05D 13/00 |
| DE | 20017995 | U1 | * | 12/2000 | E05D 15/0634 |
| DE | 20213572 | U1 | * | 12/2002 | A61B 17/7035 |
| EP | 1040781 | A2 | * | 10/2000 | A47K 3/34 |
| TW | M431939 | U | | 6/2012 | |
| WO | WO-02086266 | A1 | * | 10/2002 | A47K 3/30 |
| WO | WO-2006137804 | A1 | * | 12/2006 | A47K 3/34 |
| WO | WO-2020042546 | A1 | * | 3/2020 | |

* cited by examiner

ANTI-DERAILING DEVICE FOR SLIDING DOOR

FIELD OF THE INVENTION

The present invention relates to an anti-derailing device, in particular to an anti-derailing device for a sliding door, which has an adjusting function and can effectively prevent derailing when the sliding door moves.

BACKGROUND OF THE INVENTION

The patent No. M431939, titled "Improved Structure of Sliding Door for Shower Enclosure", is known in the prior art, as shown in FIG. 1 and FIG. 2, wherein a glass sliding door 1 includes a sliding rail rod 11 fixed to a wall surface, and a plurality of clamping members 12 provided on the sliding rail rod 11 and movable along the sliding rail rod 11. A clamp-fixer 111 of the sliding rail rod 11 is used for clamping and fixing the fixed door 10 of the glass sliding door 1, and the movable door 100 of the glass sliding door 1 arranged behind the fixed door 10 is locked behind a plurality of locking members 121 provided at lower edges of the clamping members 12, upper edges of the clamping members 12 are respectively provided with a first slide roller 122 and a second slide roller 123 which correspond to each other and are hung on the sliding rail rod 11, so that the sliding rail rod 11 is clamped between the first slide rollers 122 and the second slide rollers 123 and arranged on the outer side of a door frame of a shower enclosure; the glass sliding door 1 is opened or closed by reciprocating sliding of the first and second slide rollers 122 and 123 along the sliding rail rod 11, thereby facilitating assembly of the glass sliding door 1 of the shower enclosure. However, the prior glass sliding door 1 still has the following defects in use:

1. the glass sliding door 1 is usually assembled on the outer side of the door frame, the sliding rail rod 11 is arranged above the door frame, a gap 110 is formed between the upper edge of the glass sliding door 1 and the sliding rail rod 11 due to their combination by the clamping members 12, the glass sliding door 1 is thus not suitable to be assembled on the inner side of the door frame for use in the shower enclosure, because water may be very likely to splash out from the gap 110 when a user is taking a shower, resulting in a poor shielding performance of the glass sliding door 1;

2. the first and second slide rollers 122 and 123 are fixedly arranged on the upper edges of the clamping members 12, in the case of different sizes of sliding rail rod 11 of the glass sliding door 1, distances between the first slide rollers 122 and the second slide rollers 123 cannot be slightly adjusted to adapt to the size of the sliding rail rod 11 if the distances are too large or too small, resulting in difficulties for different sizes of slide rail rod 11 to be clamped between the first and second slide rollers 122 and 123.

Furthermore, a prior glass sliding door 2 which can be used on the inner side of a door frame has been developed to address the defects of the glass sliding door 1. As shown in FIG. 3, the glass sliding door 2 includes a sliding rail rod 21 fixed to a wall surface, and a plurality of hanging bases 22 provided on the sliding rail rod 21 and movable along the sliding rail rod 21. The hanging bases 22 are respectively provided with a fixed sheet body 221, the upper edges of the fixed sheet bodies 221 are respectively and fixedly provided with a slide roller 222 and a convex stopper 223 which are arranged up and down and have concave arc-shaped inner peripheries, the slide rollers 222 of the hanging bases 22 respectively perform reciprocating sliding along the sliding rail rod 21, the convex stoppers 223 fixed on the upper edges of the fixed sheet bodies 221 are fitted and fixed below the sliding rail rod 21, and a plurality of locking members 224 are provided at lower edges of the fixed sheet bodies 221. However, the prior glass sliding door 2 still has the following defects in use:

1. the glass sliding door 2 can only be assembled on the outer side of the door frame, if the glass sliding door 2 is assembled on the inner side of the door frame, a gap is formed between the movable door 20 of the glass sliding door 2 and the door frame, and the whole door frame cannot be sealed when the movable door 20 of the glass sliding door 2 is closed;

2. the slide rollers 222 and the convex stoppers 223 of the prior glass sliding door 2 are respectively fixed on upper edges of the hanging bases 22, in the case of different sizes of sliding rail rods 21 of the glass sliding door 2, distances between the slide rollers 222 and the convex stoppers 223 cannot be slightly adjusted to adapt to the size of the sliding rail rod 21 if the distances are too large or too small, resulting in difficulties for different sizes of slide rail rods 21 to be clamped between the slide rollers 222 and the convex stoppers 223.

Furthermore, a prior glass sliding door 3 which can be used on the inner side of a door frame has been developed still to address the defects of the glass sliding door 2. As shown in FIG. 4, the glass sliding door 3 includes a sliding rail rod 31 fixed to a wall surface, and a plurality of upper slide rollers 32 and a plurality of lower slide rollers 33 which are respectively provided on the sliding rail rod 31 and move along the sliding rail rod 31. The sliding rail rod 31 has to be pre-machined to comprise a plurality of holes 311 matched with a plurality of connecting members 312 to fix the sliding rail rod 31 to a wall surface, causing not only troubles to assemble, but also extra time for pre-machining the holes 311. In addition, since the upper slide rollers 32 and the lower slide rollers 33 are fixed at appropriate positions of the glass sliding door 3, the glass sliding door 3 has a reciprocating movement along with the sliding rail rod 31 by using the upper slide rollers 32 and the lower slide rollers 33, respectively, and can resist derailing from the sliding rail rod 31 by using the lower slide rollers 33. However, it's not only troublesome to assemble the prior glass sliding door 3, but a plurality of fixing holes 300 which are respectively fitted and combined with the upper slide rollers 32 and the lower slide rollers 33 have to be drilled near above the glass sliding door 3 to fix the upper slide rollers 32 and the lower slide rollers 33 on the glass sliding door 3, and the upper slide rollers 32 and the lower slide rollers 33 are inserted into the fixing holes 300 of the glass sliding door 3, respectively. If positions of the fixing holes 300 of the glass sliding door 3 have any deviation, the distances between the upper slide rollers 32 or the lower slide rollers 33 and the fixing holes 300 cannot be adjusted, adaptions to different sizes of sliding rail rods 31 cannot be realized, and distances between the upper slide rollers 32 or the lower slide rollers 33 and the glass sliding door 3 are likely to vary, causing deviation between the sliding rail rod 31 and the upper slide rollers 32 or the lower slide rollers 33, it can thus be not smooth in opening and closing the glass sliding door 3, or even worse, the glass sliding door 3 is stuck completely, which is not desirable.

As such, the sliding rail rod 31 of the glass sliding door 3 must be provided with the preset holes 311 to fit the connecting members 312 for fixation onto the wall surface, which is time-consuming and inconvenient to install, and the positions of the fixing holes 300 of the glass sliding door 3 are easy to deviate, it can thus be not smooth in opening and closing the glass sliding door 3, or even worse, the glass sliding door 3 is stuck completely, therefore, improvement is necessary.

SUMMARY OF THE INVENTION

An object of the present invention is to provide an anti-derailing device for a sliding door, which can effectively prevent a rail from derailing during movement of the sliding door in order to solve the defects and limitations of the prior glass sliding door, and which makes it convenient for the rail to connect to a wall surface without pre-machined holes fitting connecting members, and makes it possible to easily adjust combination positions between the slide rollers or the anti-bounce rollers and the sliding door, respectively, so that each slide roller and each anti-bounce roller has an adjusting function, and the overall convenience in the use of the anti-derailing device for the sliding door is greatly improved.

In order to realize the above object, the invention provides an anti-derailing device for a sliding door, including a plurality of slide rollers, a plurality of anti-bounce rollers, a plurality of rail supporting bases, and a rail. The plurality of slide rollers are respectively arranged on upper edges of two sides of the sliding door, the plurality of slide rollers respectively include a fixed part and a first adjusting part, the first adjusting part respectively include a first eccentric roller fitted and combined with a side edge of the fixed part, a first adjusting screw penetrating into the inner side of the first eccentric roller and adjusting position of the fixed part, and a first sealing sleeve fixedly provided on the outer side of the first eccentric roller and the first adjusting screw. The plurality of anti-bounce rollers are respectively arranged on the upper edges of the two sides of the sliding door and correspondingly provided below the plurality of slide rollers respectively, the plurality of anti-bounce rollers respectively include a fixing part and a second adjusting part, an end of the fixing part opposite to the second adjusting part is screwed with an external member, and the second adjusting part includes a second eccentric roller fitted and combined with a side edge of the fixing part, a second adjusting screw penetrating into the second eccentric rollers towards the inner side thereof and adjusting positions of the fixing parts, and a second sealing sleeve fixedly provided on the outer side of the second eccentric rollers and the second adjusting screws. The plurality of rail supporting bases are respectively arranged on a fixed door in front of the sliding door, the plurality of rail supporting bases respectively include a positioning part and a holding part fitted and combined on a side edge of the positioning part, the positioning part is arranged on the outer side of the fixed door, the holding part is arranged on the inner side of the fixed door and correspond to the positioning part, and the holding parts respectively include a first holding base, a second holding base engaged with the first holding base and a fixing member adjusting an engagement distance between the first holding base and the second holding base, a groove is provided at the bottom of the first holding base so that the external members are not be hindered when the plurality of anti-bounce rollers move, and distances between the plurality of slide rollers and the plurality of anti-bounce rollers is adjustable. The rail comprises two fixers which are respectively provided at two ends of the rail and positioned on one side edge of the sliding door and one side edge of the fixed door faced to the one side edge of the sliding door, the rail is clamped between the plurality of slide rollers and the plurality of anti-bounce rollers to allow the sliding door to be opened and closed when the plurality of slide rollers respectively have a reciprocating movement along with the rail, and the rail is supported on the first holding bases and the second holding bases when the sliding door is being opened.

1. Furthermore, the fixed part of each of the plurality of slide rollers is provided with a convex connector facing an end of the first adjusting parts, and a fitting hole is formed in the convex connector, and an outer edge of the fixed part is formed as a concave arc body, so that the concave arc body on an outer edge of the slide roller has a reciprocating movement along with the rail, wherein the first eccentric roller comprises a first screw connector at an end opposite to the fixed part, and a first convex connecting rod is connected with the first screw connector and extends towards an end of the fixed part in an eccentric manner, and a first fitted ring is fitted around an outer periphery of the first convex connecting rod, and the first screw connector is internally provided with a first sunk hole, and a first eccentric hole communicated with the first sunk hole is formed in an eccentric position of the first convex connecting rod, so that the first adjusting screw penetrates through the first sunk hole and extends into the first eccentric hole to adjust a distance between one of the plurality of slide rollers and the corresponding anti-bounce roller, and wherein the first adjusting screw is provided with a first external threaded section to penetrate into the first sunk hole of the first eccentric roller and extend into the first eccentric hole, so that the first adjusting screw penetrates into the fitting hole of the convex connector to be screwed and fixed in the fixed part, and wherein the first sealing sleeve is provided with a first internal threaded hole facing the first screw connector of the first eccentric roller, so that the first screw connector is screwed in the first internal threaded hole.

Furthermore, a screw hole is formed in the fixing part of each of the plurality of anti-bounce rollers, an outer edge of the fixing part is formed as a straight rod body, and the straight rod body is provided with a convex connector facing the second adjusting part, and a hole communicated with the screw hole is formed in the convex connector, and the external member is provided with a convex screwing section screwed with front end of the screw hole of the fixing part, and an outer diameter of the convex connector is equal to a outer diameter of the second sealing sleeve, wherein the second eccentric roller are provided with a second screw connector at an end opposite to the fixing part, and a second convex connecting rod is connected with the second screw connector and extends towards an end of the fixing part in an eccentric manner, and wherein a second fitted ring is fitted around an outer periphery of the second convex connecting rod, and a second sunk hole is respectively arranged in the second screw connector, a second eccentric hole communicated with the second sunk hole is formed in an eccentric position of the second convex connecting rod, so that the second adjusting screw penetrates through the second sunk holes and extends into the second eccentric holes to adjust a distance between one of the plurality of anti-bounce rollers and the corresponding slide roller, and wherein the second adjusting screw is provided with a second external threaded section to penetrate into the second sunk hole of the second eccentric roller and extend into the second eccentric holes, so that the second adjusting screw penetrates into the hole of the convex connector and is screwed and fixed at rear ends of the screw hole of the fixing part, and wherein the second sealing sleeve is provided with a second internal threaded hole facing the second screw connector of the second eccentric roller, so that the second screw connector is screwed in the second internal threaded hole.

Furthermore, an outer diameter of the straight rod body of the fixing part is smaller than an outer diameter of the external member.

Furthermore, the first holding base of each of the plurality of rail supporting bases is provided with an abutting body facing the positioning part to abut against the fixed door, and a holding surface extending from the abutting body towards the second holding base, aside of the holding surface is formed with a first concave arc edge for arranging and positioning the rail, and the holding surface is provided with a hole located near the bottom end and facing the second holding base, and wherein a side of the second holding base facing the first holding base is formed with a bearing surface, and a height of the bearing surface is the same height as a height of the holding surface, and a second concave arc edge is formed by being curved towards the first holding base and fits the first concave arc edge to hold and position the rail, and a side of the second holding base away from the first holding base is provided with a ring groove for a ring gasket to fit in, and a bottom of the second holding base facing the ring groove is provided with a positioning hole corresponding to the hole, and a bottom of the ring gasket is provided with a notch corresponding to the positioning hole, and wherein the fixing member penetrates into the positioning holes of the second holding base and extends into the hole of the first holding base to be positioned, and a cushion is disposed at the outer side of the positioning hole to shield the fixing member, and wherein the positioning part is provided with a locking member facing the holding part and is locked with the holding part.

Furthermore, a height of the second holding base is the same as a height of the abutting body of the first holding base.

Furthermore, a highest point of the first concave arc edge of the first holding base is higher than a central point of first concave arc edge, and a highest point of the second concave arc edge of the second holding base is higher than a central point of the second concave arc edge.

Furthermore, a depth of the groove at the bottom of the first holding base exceeds the bottom of the first concave arc edge of the first holding base.

The technical solution adopted by the invention may achieve the following advantageous effects:

1. Convenient operation: the rail of the anti-derailing device for the sliding door can be directly supported by the holding parts of the plurality of rail supporting bases arranged on the fixed door, the rail does not need pre-machined holes in combination with connecting members to get fixed on a wall surface, so that the rail can be directly sold to wholesalers by bulk without being pre-machined in factories according to a construction scheme;

2. Adjusting effect: according to the anti-derailing device for the sliding door, the first adjusting parts are respectively provided on the plurality of slide rollers arranged on the upper edges of the two sides of the sliding door, and the second adjusting parts are respectively provided on the plurality of anti-bounce rollers spaced from and provided correspondingly below the plurality of slide rollers, and the first eccentric rollers and the second eccentric rollers are respectively provided with the first eccentric holes and the second eccentric holes which are cut-through and deviated from the center positions of the first eccentric rollers and the second eccentric rollers; when the heights of the plurality of slide rollers are different from those of the plurality of anti-bounce rollers of the sliding door, slight adjustments can be made towards the first eccentric holes of the first eccentric rollers and the second eccentric holes of the second eccentric rollers by using the first adjusting screws and the second adjusting screws, so that the heights of the plurality of slide rollers and the anti-derailing rollers are respectively adjusted, and therefore, the overall installation and use convenience of the anti-derailing device for the sliding door can be greatly improved, and an excellent effect of adjustment between the anti-derailing device for the sliding door and the rail of the sliding door is rendered;

3. Anti-derailing effect: an end of the fixed parts opposite to the first adjusting parts and the grooves at the bottom of the first holding bases are adjusted, so that the external members may not be hindered when the plurality of anti-bounce rollers move, distances between the plurality of slide rollers and the plurality of anti-bounce rollers can be adjusted to enable distances between the fixed parts of the plurality of slide rollers and the external members of the plurality of anti-bounce rollers are respectively smaller than an outer diameter of the rail, derailing from the rail due to the distance between the plurality of slide rollers and the plurality of anti-bounce rollers is thus prevented; and 4. Capability of being assembled on either the inner or outer side of the door frame: the plurality of slide rollers and the plurality of anti-bounce rollers are assembled on the upper edges of the two sides of the sliding door, the rail is clamped between the plurality of slide rollers and the plurality of anti-bounce rollers, the sliding door is opened and closed along with the reciprocating movement of the plurality of slide rollers along the rail, the rail can be supported on the first holding bases and the second holding bases when the sliding door is being opened, and no gap is formed between the rail and a top end of the sliding door, therefore, the sliding door can be assembled on either the inner or outer side of the door frame, so that water in a shower enclosure may not splash out from the top end of the sliding door when the sliding door is particularly used in the shower enclosure.

DETAILED DESCRIPTION OF THE PREFERRED EMBODIMENTS

The following detailed description, taken in conjunction with the accompanying drawings, illustrates how the structure of the present invention is assembled and used, and it is supposed to facilitate understandings of the objects, features, and advantages of the present invention, as well as the effects thereof.

Figure 1:
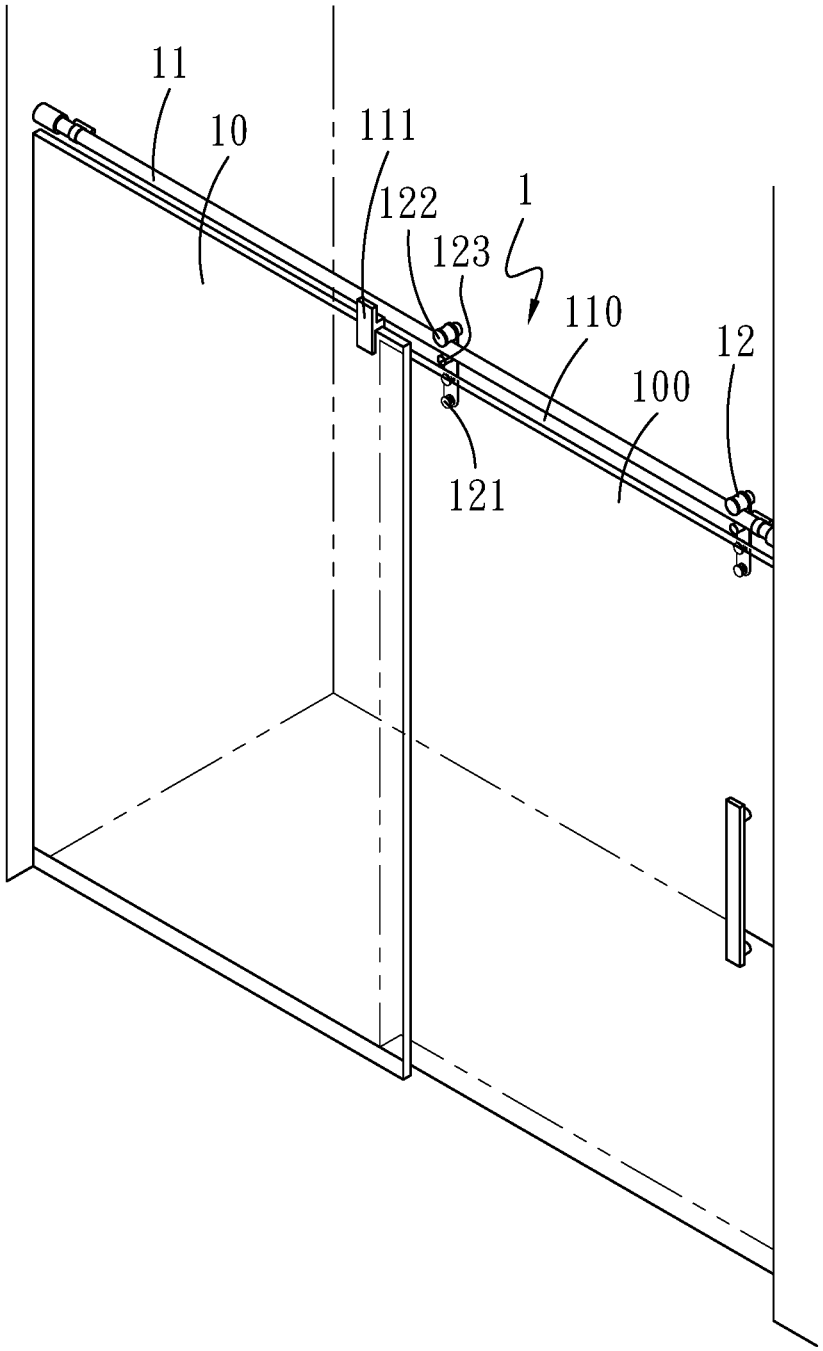
Fig.1 PRIOR ART
FIG. 1 is a perspective view of an arrangement of an improved structure of a shower sliding door of the prior patent publication No. M 431939.
Figure 2:
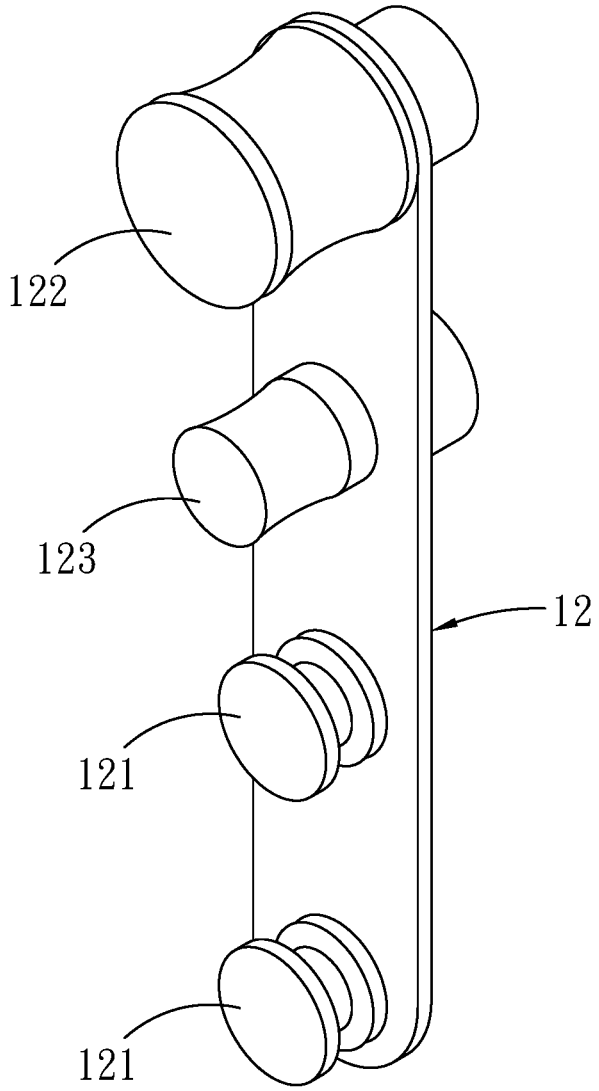
Fig.2 PRIOR ART
FIG. 2 is a perspective view of a clamping member in FIG. 1.
Figure 3:
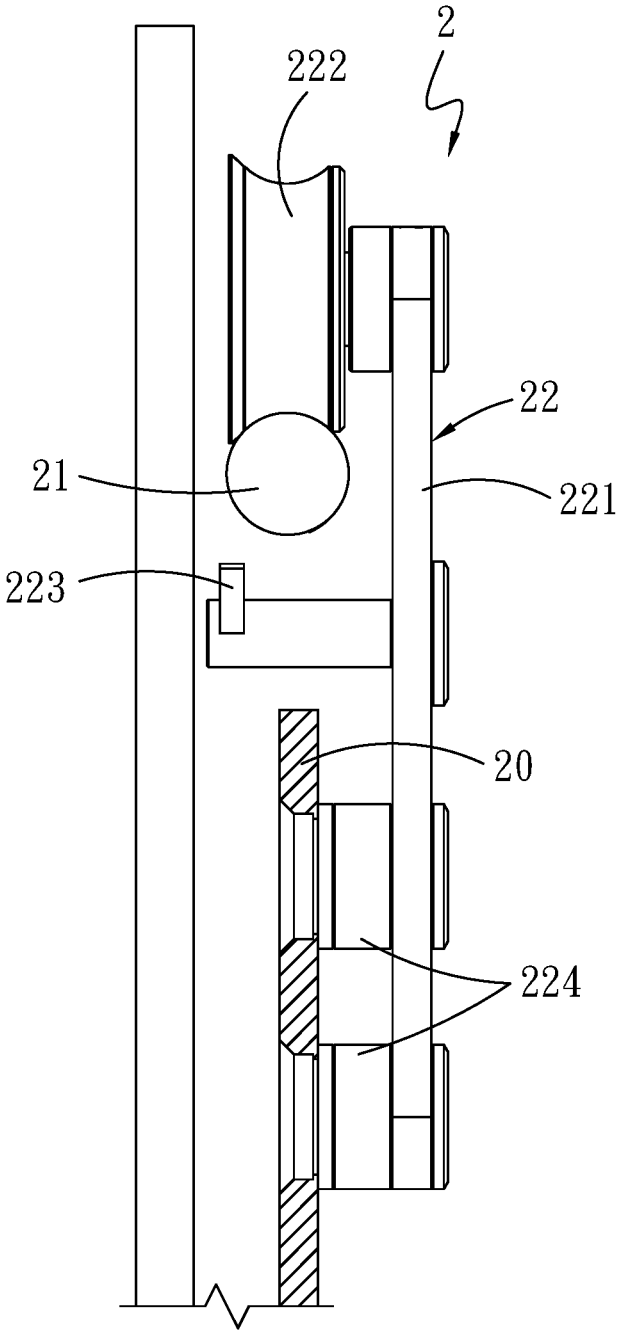
Fig.3 PRIOR ART
FIG. 3 is a side view of an arrangement of a prior glass sliding door 2.
Figure 4:
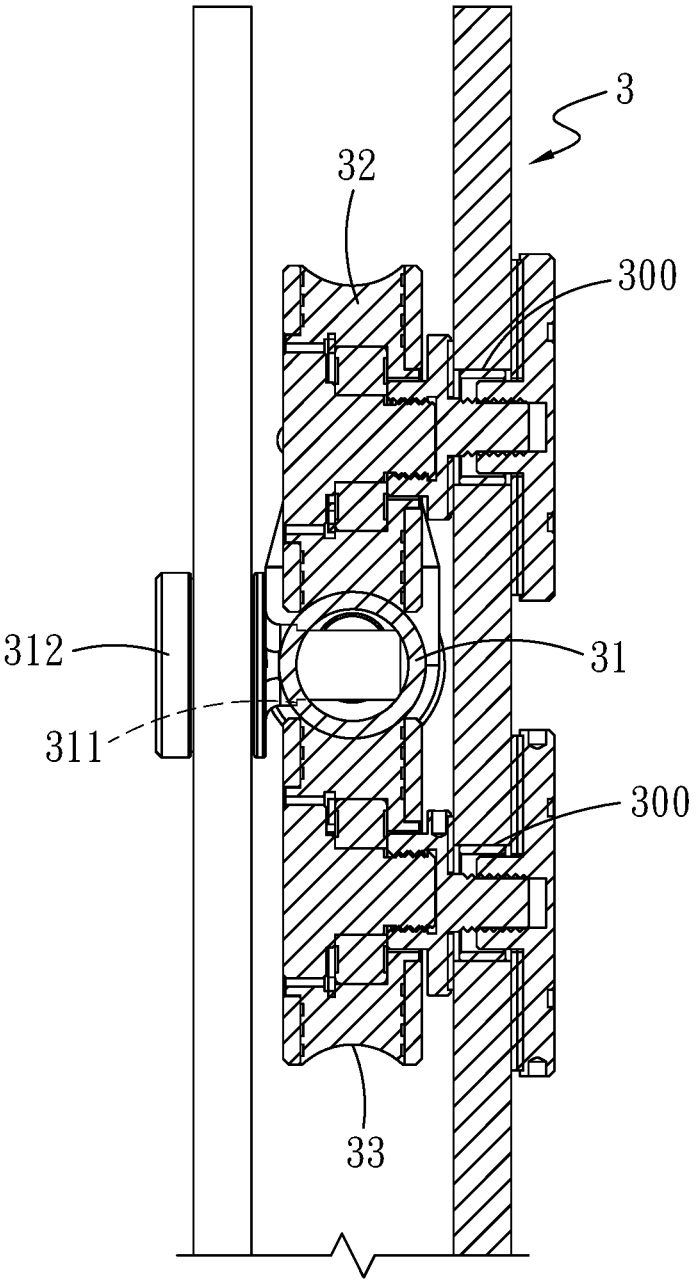
Fig.4 PRIOR ART
FIG. 4 is a side view of an arrangement of a prior glass sliding door 3.
Figure 5:
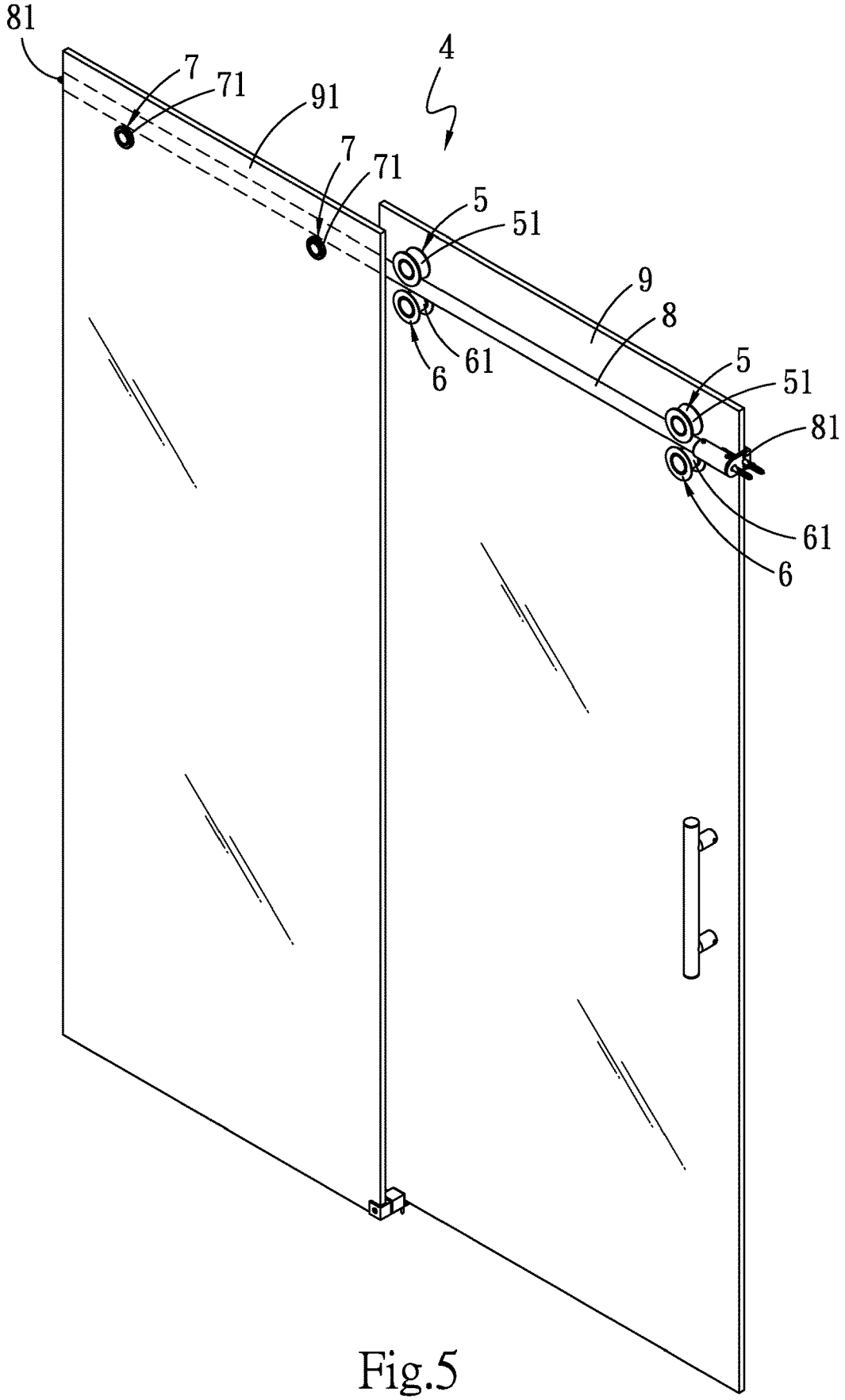
FIG. 5 is a perspective view of an arrangement of the anti-derailing device for a sliding door according to the present invention.
Figure 6:
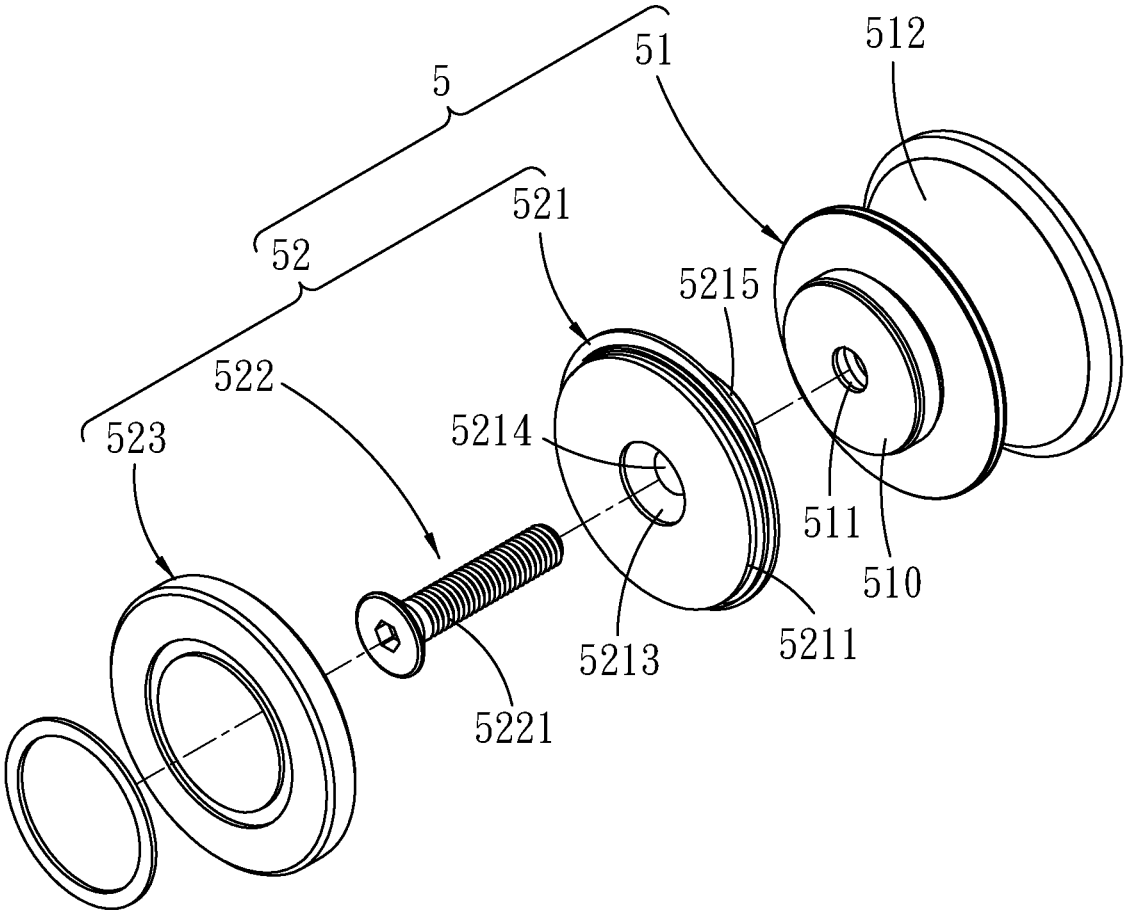
FIG. 6 is a perspective exploded view of a slide roller of the anti-derailing device for the sliding door in FIG. 5 from another angle.
Figure 7:
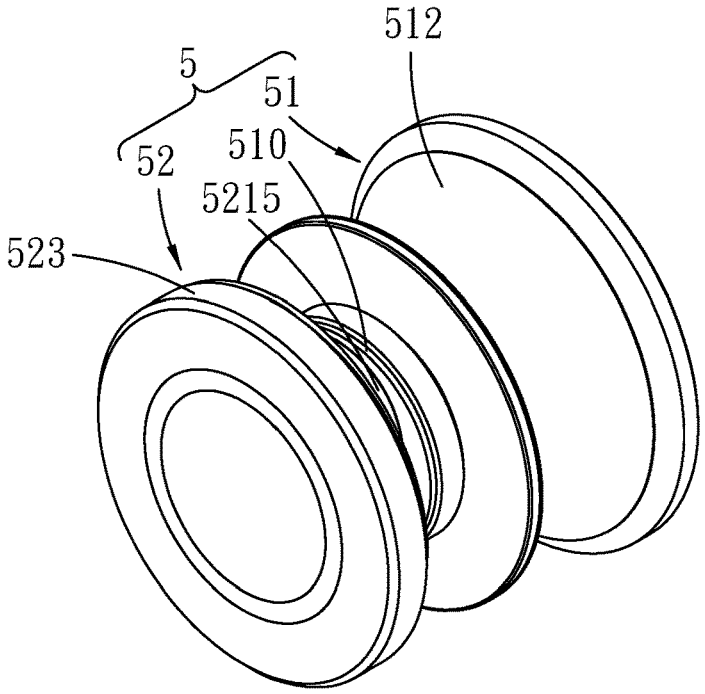
FIG. 7 is a perspective view of an assembled slide roller in FIG. 6.
Figure 8:
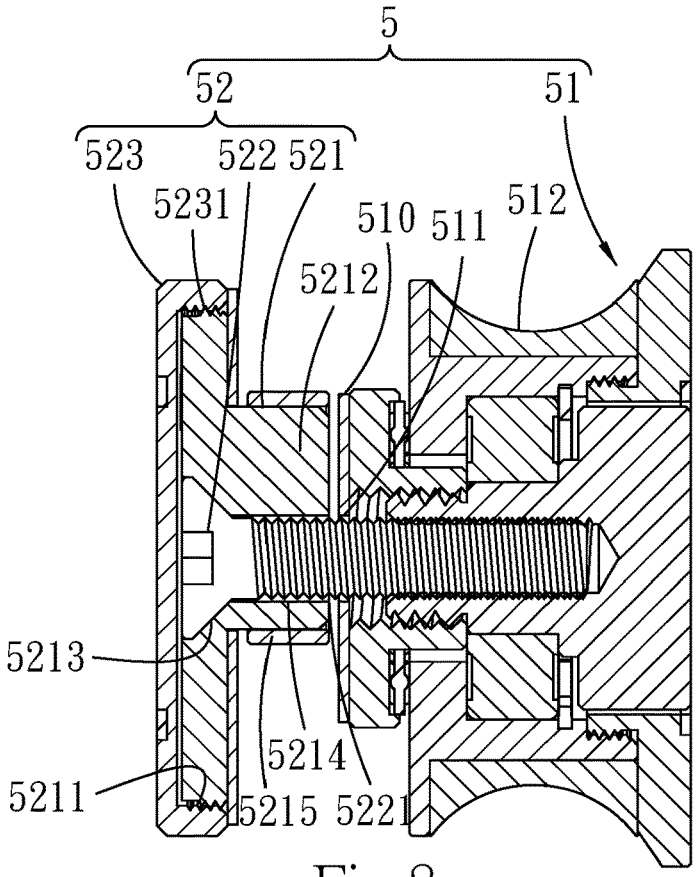
FIG. 8 is a sectional view of an assembled slide roller in FIG. 6.
Figure 9:
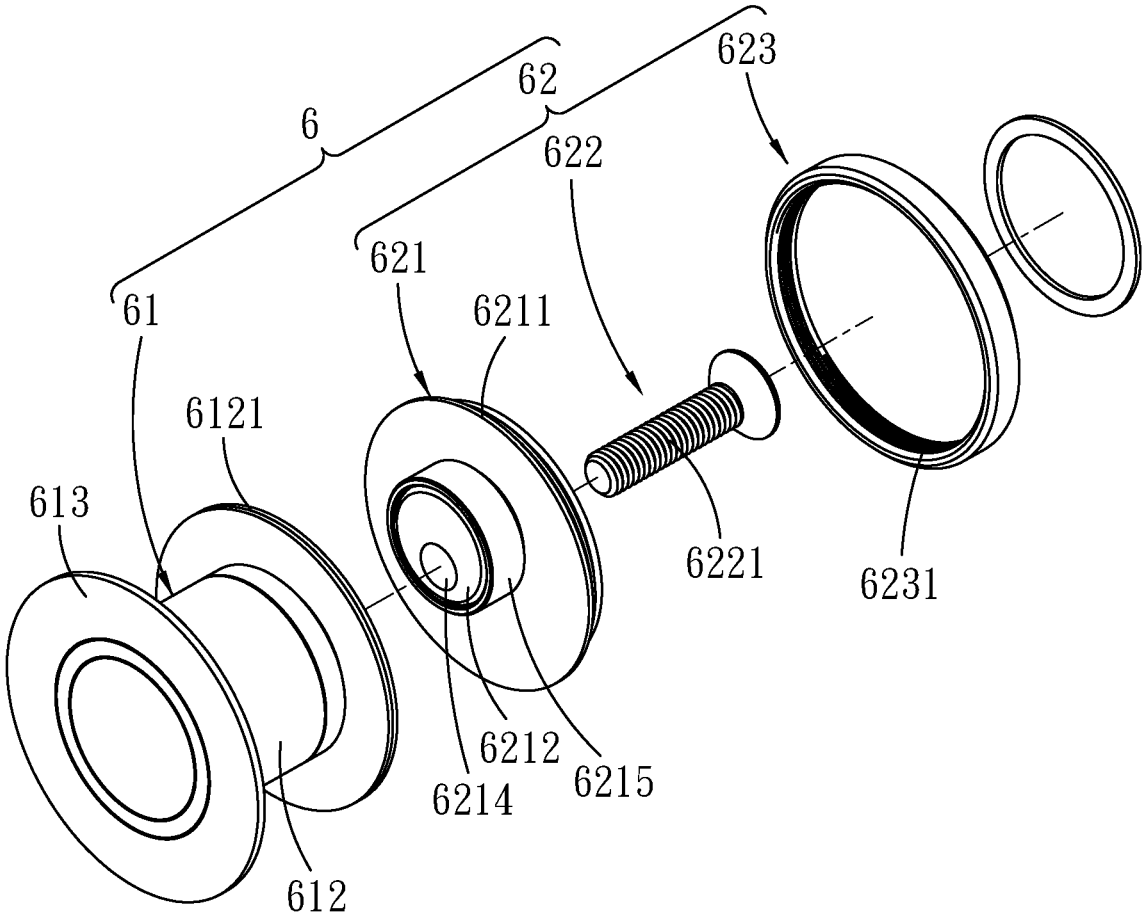
FIG. 9 is a perspective exploded view of an anti-bounce roller of the anti-derailing device for the sliding door in FIG. 5.
Figure 10:
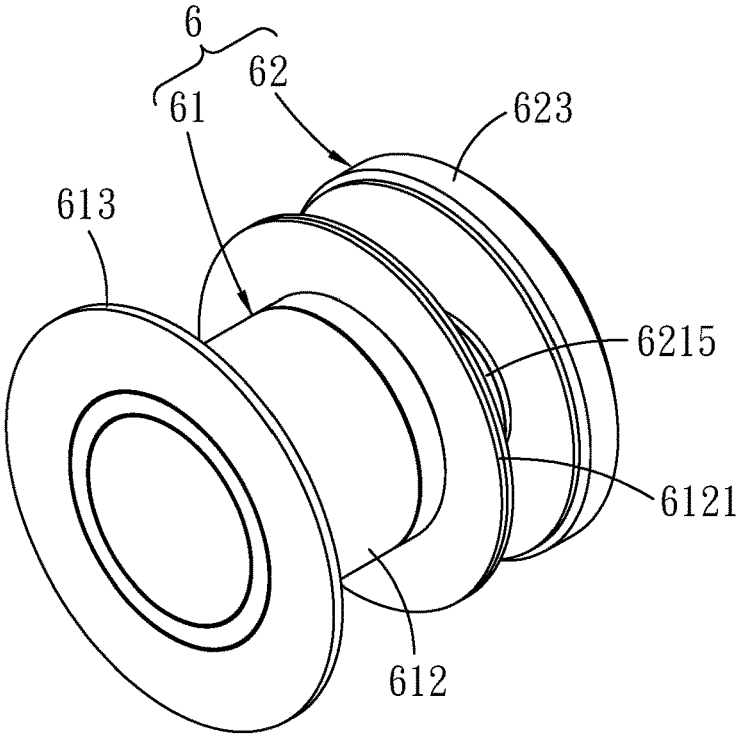
FIG. 10 is a perspective view of an assembled anti-bounce roller in FIG. 9.
Figure 11:
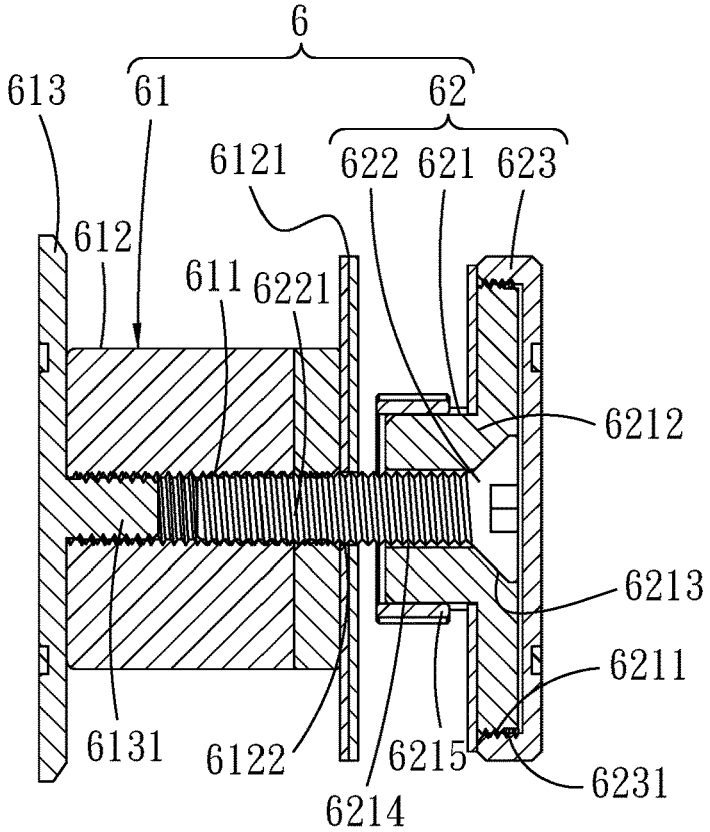
FIG. 11 is a sectional view of an assembled anti-bounce roller in FIG. 9.

Referring to FIG. 5, an anti-derailing device 4 for the sliding door includes a plurality of slide rollers 5 which are respectively provided on the upper edges of two sides of a sliding door 9, a plurality of anti-bounce rollers 6 are correspondingly provided below the plurality of slide rollers 5 respectively, a plurality of rail supporting bases 7 are respectively provided on a fixed door 91 in front of the sliding door 9, and a rail 8 is fixedly provided on the sliding door 9 and to be directly supported on the plurality of rail supporting bases 7. Two fixers 81 are respectively provided at two ends of the rail 8, so that the two fixers 81 are respectively positioned on one side edge of the sliding door 9 and one side edge of the fixed door 91 faced to the one side edge of the sliding door 9, and the rail 8 is clamped between the plurality of slide rollers 5 and the plurality of anti-bounce rollers 6, so as to allow the sliding door 9 to be opened and closed when the plurality of slide rollers 5 respectively have a reciprocating movement along with the rail 8, and the rail 8 can be supported on the plurality of rail supporting bases 7 when the sliding door 9 is being opened Referring to FIGS. 6, 7 and 8, and as shown in conjunction with FIGS. 12 and 13, in this embodiment, the upper edges of the two sides of the sliding door 9 where the plurality of slide rollers 5 and the plurality of anti-bounce rollers 6 are respectively provided with a plurality of upper holes 90 and a plurality of lower holes 900 below the upper holes 90. Preferably, two slide rollers 5 and two anti-bounce rollers 6 are respectively provided, the slide rollers 5 respectively correspond to the upper holes 90 of the upper edges of the two sides of the sliding door 9, the anti-bounce rollers 6 respectively correspond to the lower holes 900 of the upper edges of the two sides of the sliding door 9, and two upper holes 90 and two lower holes 900 are provided. One of the plurality of slide rollers 5 and one of the plurality of anti-bounce rollers 6 are taken as an example to describe the structures thereof as follows.

The slide roller 5 includes a fixed part 51 and a first adjusting part 52, wherein the fixed part 51 is provided with a convex connector 510 facing an end of the first adjusting part 52, and a fitting hole 511 is formed in the convex connector 510. An outer edge of the fixed part 51 is formed as a concave arc body 512, so that the concave arc body 512 on an outer edge of the slide roller 5 has a reciprocating movement along with the rail 8. The first adjusting part 52 includes a first eccentric roller 521 fitted and combined with a side edge of the fixed part 51, a first adjusting screw 522 penetrating into the inside of the first eccentric roller 521 and adjusting the position of the fixed part 51, and a first sealing sleeve 523 fixedly provided on the outer side of the first eccentric roller 521 and the first adjusting screw 522. More specifically, the first eccentric roller 521 comprises a first screw connector 5211 at an end opposite to the fixed part 51, and a first convex connecting rod 5212 connected to the first screw connector 5211 and extending towards an end of the fixed part 51 in an eccentric manner, wherein the first screw connector 5211 is internally provided with a first sunk hole 5213, and a first fitted ring 5215 is fitted around the outer periphery of the first convex connecting rod 5212, so that the first convex connecting rod 5212 is arranged in the upper hole 90 formed in the upper edge of the two sides of the sliding door 9. Also, a first eccentric hole 5214 communicated with the first sunk hole 5213 is formed in an eccentric position of the first convex connecting rod 5212, so that the first adjusting screw 522 penetrates through the first sunk hole 5213 and extends into the first eccentric hole 5214, and the distance between the slide roller 5 and the anti-bounce roller 6 is adjusted through the first eccentric roller 521. The first adjusting screw 522 is provided with a first external threaded section 5221 to penetrate into the first sunk hole 5213 of the first eccentric roller 521 and extend into the first eccentric hole 5214. After the position of the slide roller 5 is properly adjusted by the first eccentric roller 521, the first adjusting screw 522 penetrates into the fitting hole 511 of the convex connector 510 and is screwed and fixed in the fixed part 51. The first sealing sleeve 523 is provided with a first internal threaded hole 5231 facing the first screw connector 5211 of the first eccentric roller 521, so that the first screw connector 5211 is screwed and fixed in the first internal threaded hole 5231.

Referring to FIGS. 9, 10, 11, 12, and 13, the anti-bounce roller 6 includes a fixing part 61 and a second adjusting part 62, wherein a screw hole 611 is formed in the fixing part 61, an outer edge of the fixing part 61 is formed as a straight rod 612, and the straight rod 612 is provided with a convex connector 6121 facing the second adjusting part 62, and a hole 6122 communicated with the screw hole 611 is formed in the convex connector 6121, an external member 613 is screwed to an end of the fixing part 61 opposite to the second adjusting part 62. A convex screwing section 6131 is provided at an end of the external member 613 facing the fixing part 61, thereby the convex screwing section 6131 is screwed with the front end of the screw hole 611 of the fixing part 61. The outer diameter of the straight rod 612 of the fixing part 61 is smaller than the outer diameter of the external member 613. The second adjusting part 62 includes a second eccentric roller 621 fitted and combined with a side edge of the fixing part 61, a second adjusting screw 622 penetrating into the second eccentric roller 621 and adjusting the position of the fixing part 61, and a second sealing sleeve 623 fixedly provided on the outer side of the second eccentric roller 621 and the second adjusting screw 622. More specifically, the second eccentric roller 621 is provided with a second screw connector 6211 at an end opposite to fixing part 61, and a second convex connecting rod 6212 connected to the second screw connector 6211 and extending towards an end of the fixing part 61 in an eccentric manner, wherein the second screw connector 6211 is internally provided with a second sunk hole 6213, a second fitted ring 6215 is fitted around the outer periphery of the second convex connecting rod 6212 so that the second convex connecting rod 6212 is arranged in the lower hole 900 provided at the upper edges of the two sides of the sliding door 9. A second eccentric hole 6214 communicated with the second sunk hole 6213 is formed in an eccentric position of the second convex connecting rod 6212, so that the second adjusting screw 622 penetrates into the second sunk hole 6213 and extends into the second eccentric hole 6214, and the distance between the anti-bounce roller 6 and the slide roller 5 can be adjusted through the second eccentric roller 621. The second adjusting screw 622 is provided with a second external threaded section 6221 to penetrate into the second sunk hole 6213 of the second eccentric roller 621 and extend into the second eccentric hole 6214. The second adjusting screw 622 penetrates into the hole 6122 of the convex connector 6121 and is screwed and fixed at the rear end of the screw hole 611 of the fixing part 61 after the position of the anti-bounce roller 6 is adjusted properly by the second eccentric roller 621. The second sealing sleeve 623 is provided with a second internal threaded hole 6231 facing the second screw connector 6211 of the second eccentric roller 621, so that the second screw connector 6211 is screwed and fixed in the second internal threaded hole 6231. More specifically, the outer diameter of the convex connector 6121 is the same as the outer diameter of the second sealing sleeve 623.

Referring to FIGS. 5, 12, 14, and 16, the plurality of rail supporting bases 7 are respectively provided at both sides of the fixed door 91 so that the rail 8 can be directly supported thereby. In this embodiment, two rail supporting bases 7 are preferably provided. One of the rail supporting bases 7 is taken as an example to describe the structure thereof as follows.

The rail supporting base 7 includes a positioning part 71 and a holding part 72 fitted and combined on a side edge of the positioning part 71. The positioning part 71 is arranged on the outer side of the fixed door 91, and the positioning part 71 is provided with a locking member 711 facing the holding part 72, thereby the positioning part 71 is locked and combined with the holding part 72 through the locking member 711. The holding part 72 is arranged on the inner side of the fixed door 91 at a position corresponding to the positioning part 71, and includes a first holding base 721, a second holding base 722 engaged with the first holding base 721, and a fixing member 723 capable of adjusting the engagement distance between the first holding base 721 and the second holding base 722. More specifically, the first holding base 721 is provided with an abutting body 7211 facing the positioning part 71 and used for abutting against the fixed door 91, and a holding surface 7212 extending from the abutting body 7211 towards the second holding base 722. A side of the abutting body 7211 facing the positioning part 71 is provided with a fixing hole (not shown) for fixing the positioning part 71. The first holding base 721 is formed with a first concave arc edge 7213 connected to the holding surface 7212 for supporting and positioning the rail 8, and a hole 7214 located near the bottom end and facing the second holding base 722, A groove 7215 is formed at the bottom of the first holding base 721, and the depth of the groove 7215 exceeds the bottom of the first concave arc edge 7213, so that the external member 613 is not hindered when the anti-bounce roller 6 moves. Specifically, the external member 613 is placed into the groove 7215, and the straight rod 612 of the fixing part 61 that is screwed with the external member 613 does not abut against the bottom of the first holding base 721. Thus, the distance between the fixed part 51 of the slide roller 5 and the fixing part 61 of the anti-bounce roller 6 can be conveniently adjusted, preventing the derailment of the rail 8. Moreover, the height of the second holding base 722 is the same as the height of the abutting body 7211 of the first holding base 721. The side of the second holding base 722 facing the first holding base 721 is formed with a bearing surface 7220, and the height of the bearing surface 7220 is the same as the height of the holding surface 7212. The second holding base 722 is formed with a second concave arc edge 7221 that is curved from the bearing surface 7220 towards the first holding base 721 and conjugated with the first concave arc edge 7213 to support and position the rail 8. A side of the second holding base 722 away from the first holding base 721 is provided with a ring groove 7222 for a ring gasket 7223 to fit in. The bottom of the second holding base 722 is provided with a positioning hole 7224 corresponding to the hole 7214, and the bottom the ring gasket 7223 is provided with a notch 7225, so that the notch 7225 is facilitated to align two sides of the positioning hole 7224 when the ring gasket 7223 is fitting into the ring groove 7222. The fixing member 723 penetrates into the positioning hole 7224 of the second holding base 722 and extends into the hole 7214 of the first holding base 721. A cushion 7231 is disposed at the outside of the positioning hole 7224 to shield the fixing member 723. The fixing member 723 can be taken out after loosening by only taking out the cushion 7231, without taking apart the ring gasket 7223, and the distance between the first holding base 721 and the second holding base 722 can be adjusted to be applied with different sizes of the rails 8. The highest points of the first concave arc edge 7213 of the first holding base 721 and the second concave arc edge 7221 of the second holding base 722 are respectively higher than the central points of the first concave arc edge 7213 and the second concave arc edge 7221, so as to prevent the derailment of the rail 8 after the rail 8 is placed on the first concave arc edge 7213 and the second concave arc edge 7221. Besides, the holding part 72 of the rail supporting base 7 can directly support the rail 8, and the rail 8 can be fixed to the wall surface without pre-machining holes to fit connecting members as the conventional glass sliding door 3, whereby the sliding door 9 is more convenient to assemble and the failure rates are reduced. The rail 8 can be sold to wholesalers by bulk without being pre-machined in factories according to a construction scheme.

Figure 12:
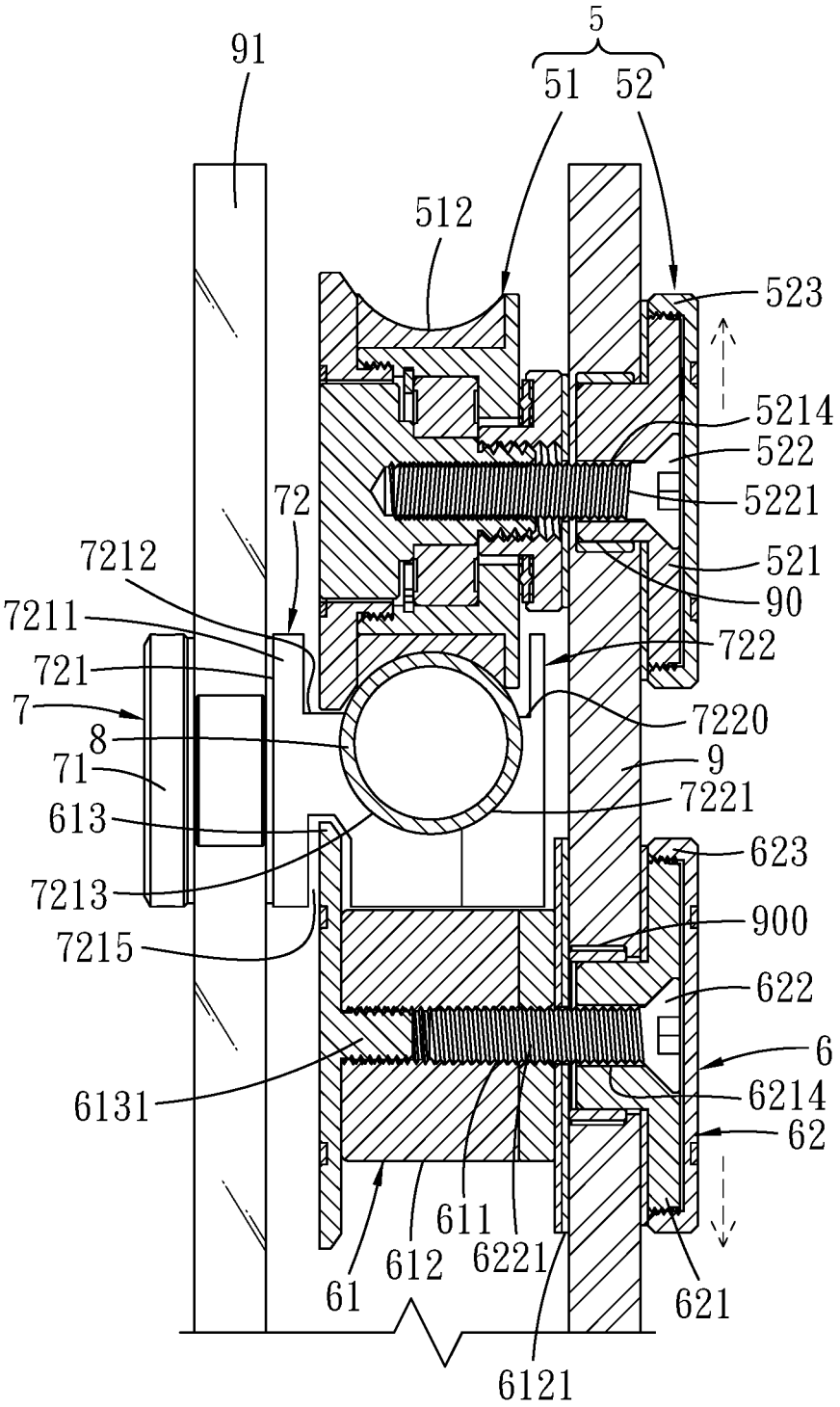
FIG. 12 is a schematic diagram showing a side view of adjustment of up and down positions of the slide roller and the anti-bounce roller on the sliding door in FIG. 5.
Figure 13:
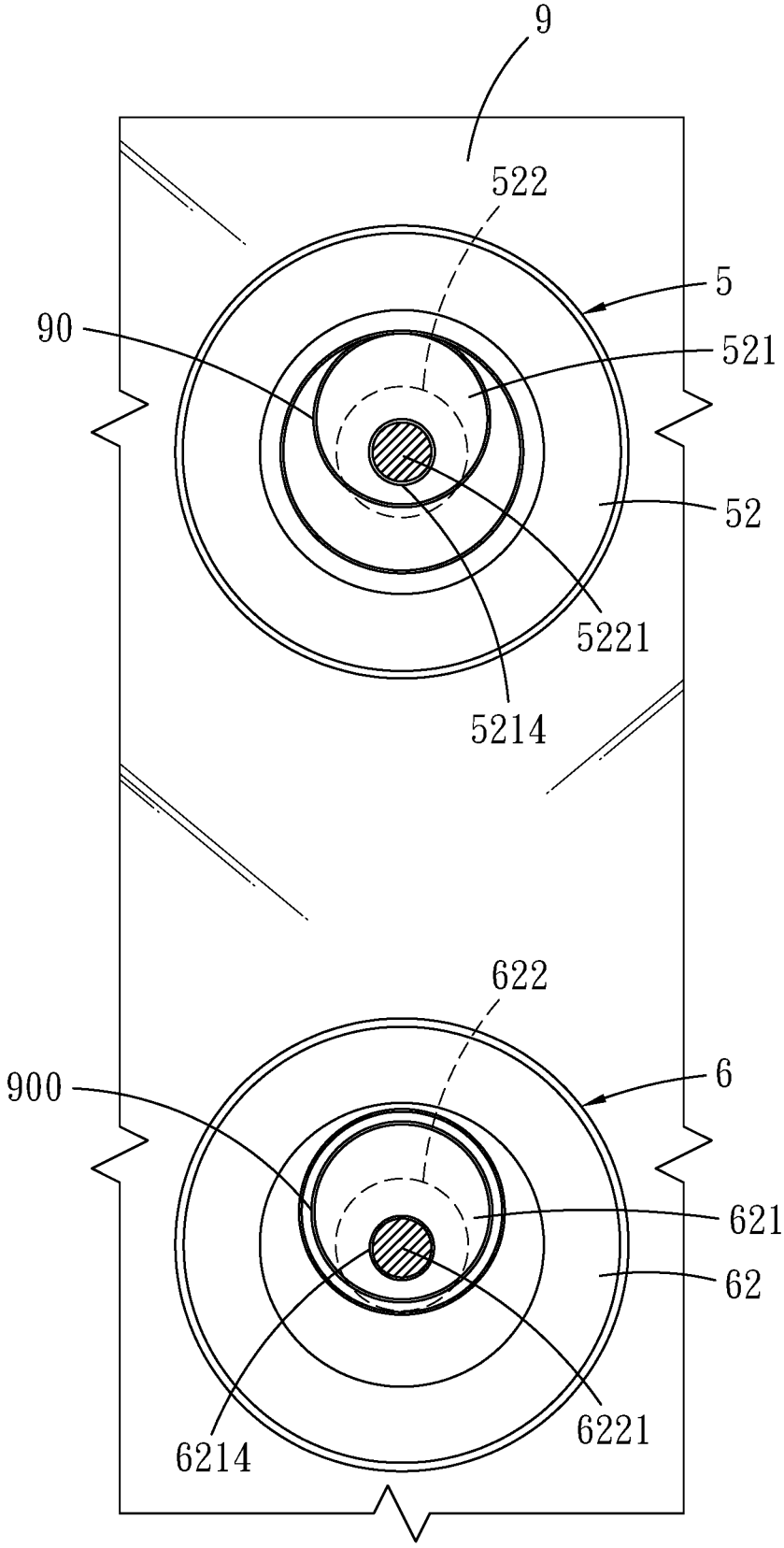
FIG. 13 is a rear view of to-be-adjusted up and down positions of the slide roller and anti-bounce roller on the sliding door in FIG. 12.
Figure 14:
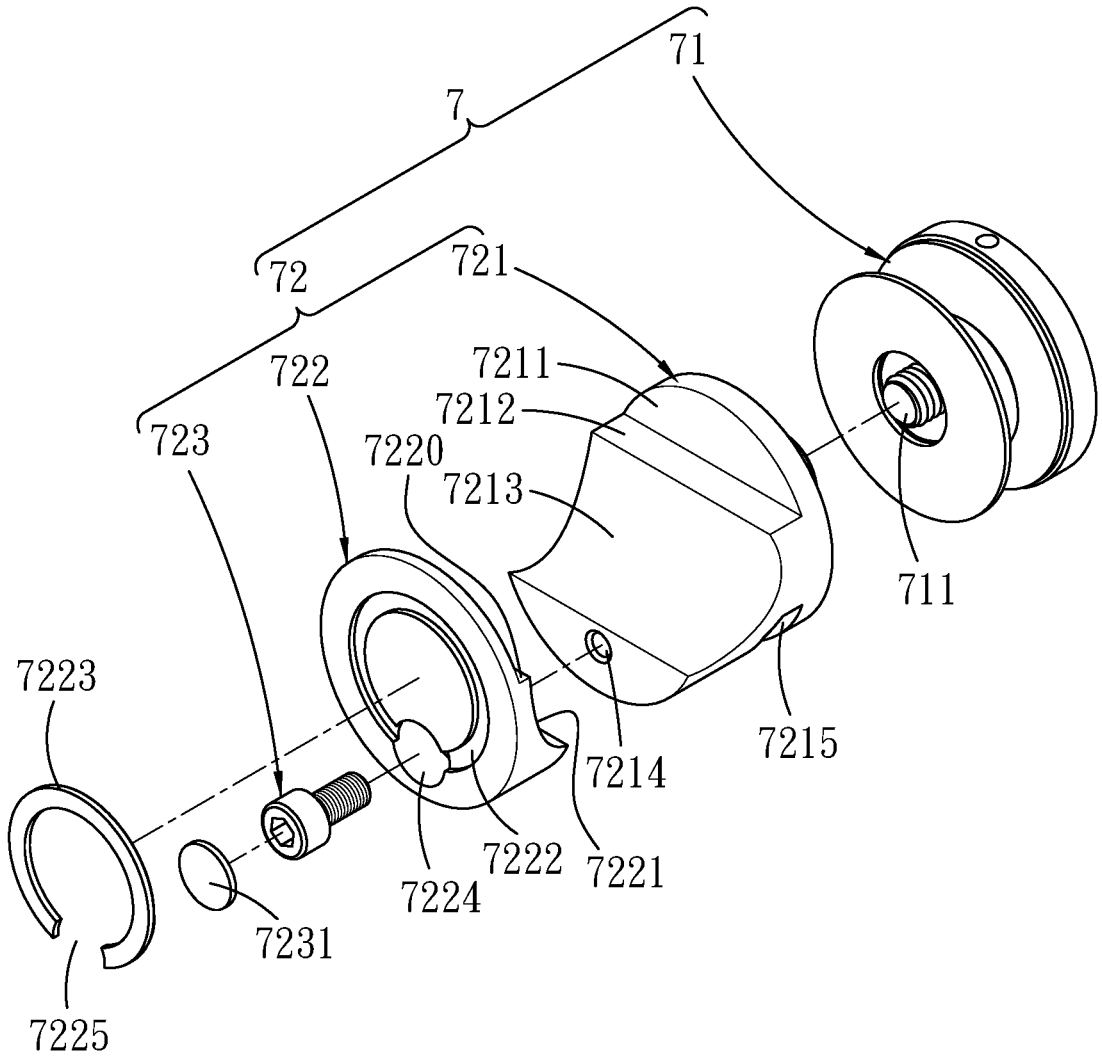
FIG. 14 is a perspective exploded view of a rail supporting base of the anti-derailing device for the sliding door in FIG. 5 from another angle.
Figure 15:
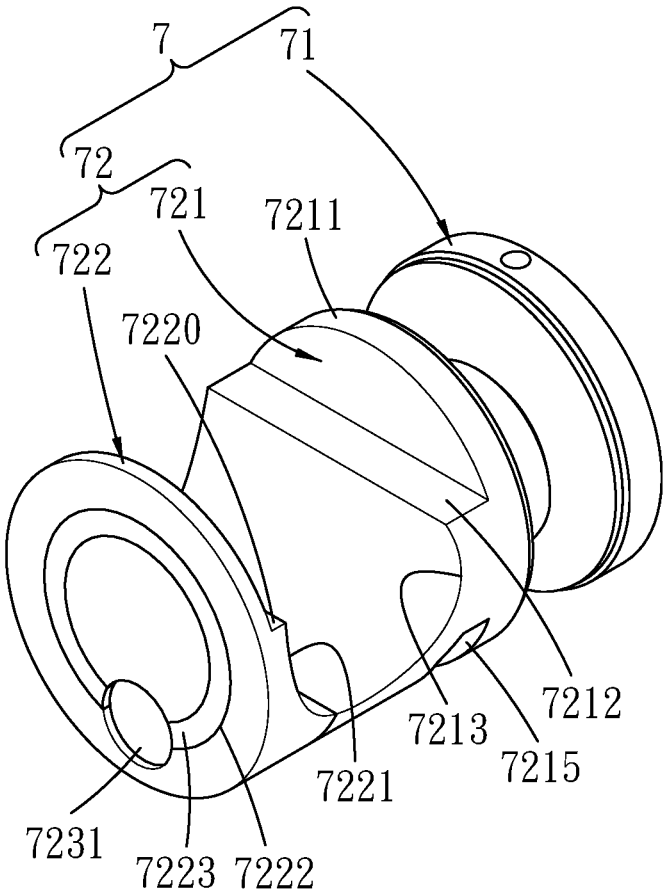
FIG. 15 is a perspective view of an assembled rail supporting base in FIG. 14.

As shown in FIGS. 5, 12, and 13, when the anti-derailing device 4 for the sliding door of the present invention is assembled, the plurality of rail supporting bases 7 are locked and fixed on the fixed door 91, and the rail 8 is clamped and fixed on the opposite outer sides of the sliding door 9 and the fixed door 91 by the fixer 81 at both ends, and the plurality of slide rollers 5 and the plurality of anti-bounce rollers 6 clamp the rail 8 therebetween, so as to allow the sliding door 9 be opened and closed when the plurality of slide rollers 5 have a reciprocating movement along with the rail 8. The rail 8 can be directly supported on the first concave arc edges 7213 of the first holding bases 721 and the second concave arc edges 7221 of the second holding bases 722 when the sliding door is being opened. Moreover, the plurality of anti-bounce rollers 6 are utilized to prevent the rail 8 derailing out from the inside of the first concave arc edges 7213 and the second concave arc edges 7221 of the plurality of rail supporting bases 7.

Figure 16:
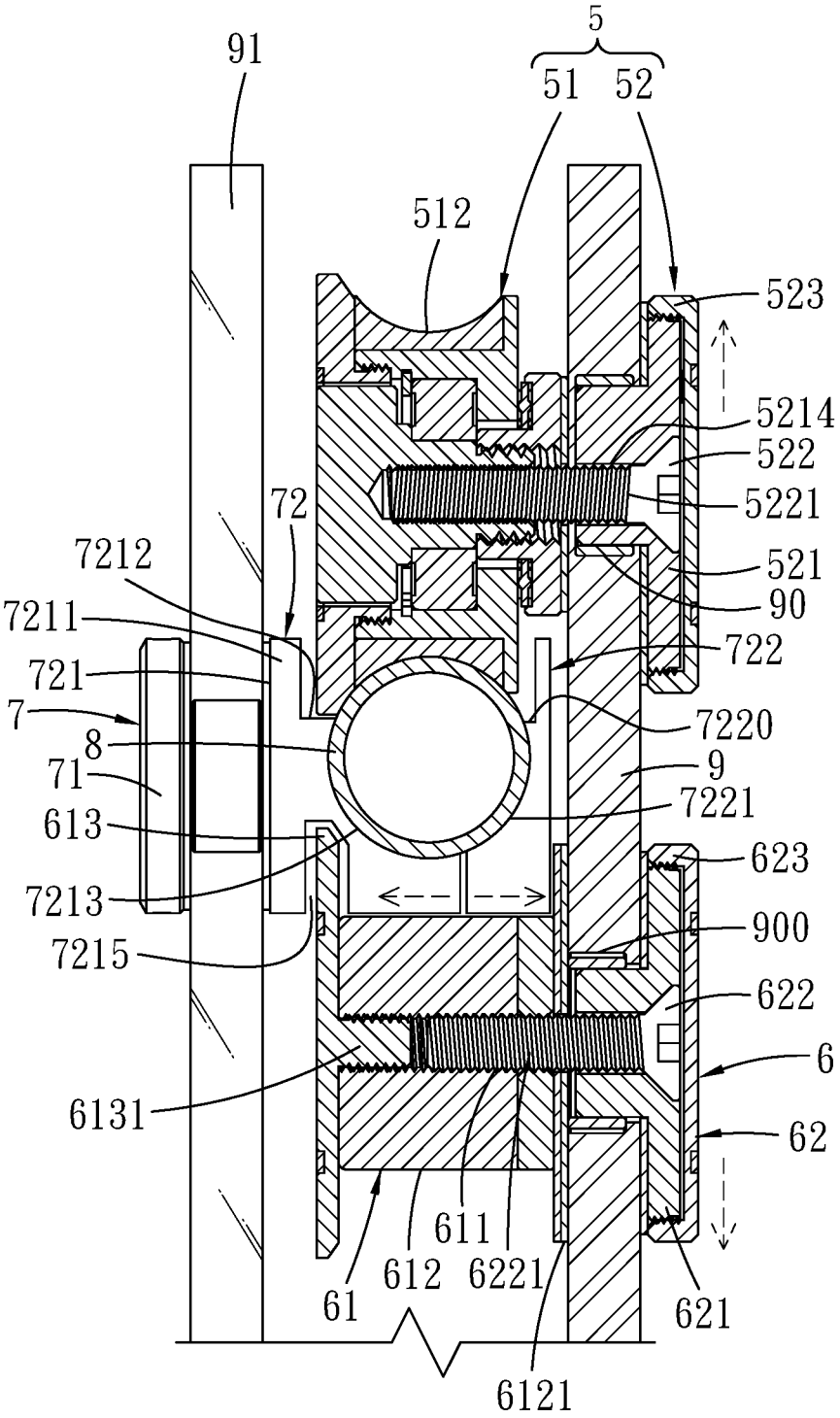
FIG. 16 is a schematic diagram showing adjustment in the case of different sizes of the rail provided for the rail supporting base in FIG. 14.

According to the invention, the rail 8 is arranged on one outer side edge of the sliding door 9 and one side edge of the fixed door 91 faced to the one side edge of the sliding door 9, and the rail 8 is clamped between the plurality of slide rollers 5 and the plurality of anti-bounce rollers 6, wherein the adjustment of the position of the plurality of slide rollers 5 and the plurality of anti-bounce rollers 6 on the sliding door 9 is performed as shown in FIGS. 5, 12, and 13. When the plurality of slide rollers 5 and the plurality of anti-bounce rollers 6 are found to be at different levels at the two ends, or when it is found that the distance between the plurality of slide rollers 5 and the plurality of anti-bounce rollers 6 provided at the upper edges of both sides of the sliding door 9 cannot satisfy the case of different sizes of the rail 8, the first sealing sleeves 523 and the second sealing sleeves 623 can be removed by unscrewing, the first adjusting screws 522 and the second sealing sleeves 623 are respectively moved into the first eccentric holes 5214 of the first eccentric rollers 521 by removing the first sealing sleeves 523 and the second sealing sleeves 623 directly from the rear of the sliding door 9 and loosening the first adjusting screws 522 and the second adjusting screws 622, so that the first adjusting screws 522 are fixed after the positions of the slide rollers 5 are readjusted, or/and the second adjusting screws 622 are respectively moved into the second eccentric holes 6214 of the second eccentric rollers 621 to readjust the positions of the plurality of anti-bounce rollers 6 and then the second adjusting screws 622 are fixed. Therefore, the rail 8 is clamped in the space between the plurality of slide rollers 5 and the plurality of anti-bounce rollers 6, and the plurality of slide rollers 5 have a reciprocating movement along with the rail 8 to allow the sliding door 9 to be opened and closed horizontally, and the sliding door 9 can move smoothly in balance without being hindered due to deviation after long-term use. In addition, since the first holding bases 721 and the second holding bases 722 are respectively matched with the adjusting and assembling structures of the fixing members 723, different distances is provided for different sizes of the rail 8 (as shown in FIG. 16) to be placed in, and the fixing members 723 respectively used for fixation after adjusting the distances between the first holding bases 721 and the second holding bases 722, the depth of the concave radian between the first concave arc edges 7213 of the first holding bases 721 and the second concave arc edges 7221 of the second holding bases 722 exceeds the middle point of the first concave arc edges 7213 and the second concave arc edges 7221 respectively, so that the rail 8 is supported and positioned in the first concave arc edges 7213 and the second concave arc edges 7221 without derailing, and the rail 8 can be assembled on one side edge of sliding door 9 and one side edge of fixed door 91 without pre-machined holes, and the plurality of slide rollers 5 and the plurality of anti-bounce rollers 6 have adjusting functions respectively, whereby the sliding door 9 can operate smoothly in balance and derailing from the rail 8 during movement is prevented effectively.

Referring to FIGS. 5, 12, and 13, the sliding door 9 is hidden behind the fixed door 91 when pulled to the left, and the sliding door 9 is in the open state, and when the sliding door 9 is being opened, the plurality of anti-bounce rollers 6 are pulled apart from the rail 8 in order to keep away from the plurality of rail supporting bases 7. When the plurality of slide rollers 5 and the plurality of anti-bounce rollers 6 do not pass by the plurality of rail supporting bases 7, in order to reduce the risk of the derailment of the rail 8 when the distance between the plurality of slide rollers 5 and the plurality of anti-bounce rollers 6 is too large, an end of the fixing parts 51 opposite to the first adjusting parts 52 and the grooves 7215 at the bottom of the first holding bases 721 are used to allow the external members 613 may not obstruct when the plurality of anti-bounce rollers 6 move and the distance between the plurality of slide rollers 5 and the plurality of anti-bounce rollers 6 is adjusted, avoiding an excessive distance between the plurality of slide rollers 5 and the plurality of anti-bounce rollers 6. Moreover, the distance between the fixing parts 51 of the plurality of slide rollers 5 and the external members 613 of the plurality of anti-bounce rollers 6 is rendered smaller than the outer diameter of the rail 8, so as to prevent the rail 8 from derailing from the plurality of slide rollers 5 and the plurality of anti-bounce rollers 6. In addition, the concave arc bodies 512 of the plurality of slide rollers 5 and the straight rod 612 of the plurality of anti-bounce rollers 6 properly clamp the rail 8, so that the sliding door 9 may not deviate or derail in the sliding process, and the optimal performance of opening and closing of the sliding door 9 is ensured.

Furthermore, in the above structure, the plurality of slide rollers 5 and the plurality of anti-bounce rollers 6 are respectively arranged on the upper edge and the lower edge of the two sides of the sliding door 9, and the rail 8 is clamped between the plurality of slide rollers 5 and the plurality of anti-bounce rollers 6, and the plurality of slide rollers 5 have a reciprocating movement along with the rail 8 to allow the sliding door 9 to be opened and closed according to the movement of the plurality of slide rollers 5, and the rail 8 is directly supported on the first concave arc edges 7213 of the first holding bases 721 and the second concave arc edges 7221 of the second holding base 722 when the sliding door 9 is being opened, without forming a gap between the rail 8 and the top end of the sliding door 9, so that the sliding door 9 can be assembled either on the inner or outer side of the door frame through the anti-derailing device 4 for the sliding door, thereby water in a shower enclosure may not splash out from the top end of the sliding door 9 when the sliding door 9 is used in the shower enclosure.

What is claimed is:

1. An anti-derailing device for a sliding door, comprising:

a plurality of slide rollers, respectively arranged on upper edges of two sides of the sliding door, and respectively including a fixed part and a first adjusting part, wherein the first adjusting part includes a first eccentric roller fitted and combined with a side edge of the fixed part, a first adjusting screw penetrating into an inner side of the first eccentric roller and adjusting position of the fixed part, and a first sealing sleeve fixedly provided on an outer side of the first eccentric roller and the first adjusting screw;

a plurality of anti-bounce rollers, respectively arranged on the upper edges of the two sides of the sliding door and correspondingly provided below the plurality of slide rollers respectively, the plurality of anti-bounce rollers respectively including a fixing part and a second adjusting part, wherein an end of the fixing part opposite to the second adjusting part is screwed with an external member, and the second adjusting part includes a second eccentric roller fitted and combined with a side edge of the fixing part, a second adjusting screw penetrating into the second eccentric roller towards an inner side thereof and adjusting positions of the fixing part, and a second sealing sleeve fixedly provided on an outer side of the second eccentric roller and the second adjusting screw;

a plurality of rail supporting bases, respectively arranged on a fixed door in front of the sliding door, and respectively including a positioning part and a holding part fitted and combined on a side edge of the positioning part, wherein the positioning part is arranged on an outer side of the fixed door, the holding part is arranged on an inner side of the fixed door and correspond to the positioning part, and wherein the holding part includes a first holding base, a second holding base engaged with the first holding base and a fixing member adjusting an engagement distance between the first holding base and the second holding base, and a groove is provided at a bottom of the first holding base so that the external members are not hindered when the plurality of anti-bounce rollers move, and distances between the plurality of slide rollers and the plurality of anti-bounce rollers is adjustable; and a rail, comprising two fixers which are respectively provided at two ends of the rail, wherein one of the two fixers is positioned on one side edge of the sliding door, another one of the two fixers is positioned on one side edge of the fixed door opposite to the sliding door, and wherein the rail is clamped between the plurality of slide rollers and the plurality of anti-bounce rollers to allow the sliding door to be opened and closed when the plurality of slide rollers respectively have a reciprocating movement along with the rail, and the rail is supported on the first holding bases and the second holding bases when the sliding door is being opened.

2. The anti-derailing device for the sliding door according to claim 1, wherein the fixed part of each of the plurality of slide rollers is provided with a convex connector facing an end of the first adjusting parts, and a fitting hole is formed in the convex connector, and an outer edge of the fixed part is formed as a concave arc body, so that the concave arc body on an outer edge of the slide roller has a reciprocating movement along with the rail, wherein the first eccentric roller comprises a first screw connector at an end opposite to the fixed part, and a first convex connecting rod is connected with the first screw connector and extends towards an end of the fixed part in an eccentric manner, and a first fitted ring is fitted around an outer periphery of the first convex connecting rod, and the first screw connector is internally provided with a first sunk hole and a first eccentric hole communicated with the first sunk hole is formed in an eccentric position of the first convex connecting rod, so that the first adjusting screw penetrates through the first sunk hole and extends into the first eccentric hole to adjust a distance between one of the plurality of slide rollers and the corresponding anti-bounce roller, and wherein the first adjusting screw is provided with a first external threaded section to penetrate into the first sunk hole of the first eccentric roller and extend into the first eccentric hole, so that the first adjusting screw penetrates into the fitting hole of the convex connector to be screwed and fixed in the fixed part, and wherein the first sealing sleeve is provided with a first internal threaded hole facing the first screw connector of the first eccentric roller, so that the first screw connector is screwed in the first internal threaded hole.

3. The anti-derailing device for the sliding door according to claim 1, wherein a screw hole is formed in the fixing part of each of the plurality of anti-bounce rollers, an outer edge of the fixing part is formed as a straight rod body, and the straight rod body is provided with a convex connector facing the second adjusting part, and a hole communicated with the screw hole is formed in the convex connector, and the external member is provided with a convex screwing section screwed with front end of the screw hole of the fixing part, and an outer diameter of the convex connector is equal to a outer diameter of the second sealing sleeve, wherein the second eccentric roller are provided with a second screw connector at an end opposite to the fixing part, and a second convex connecting rod is connected with the second screw connector and extends towards an end of the fixing part in an eccentric manner, and wherein a second fitted ring is fitted around an outer periphery of the second convex connecting rod, and a second sunk hole is respectively arranged in the second screw connector, a second eccentric hole communicated with the second sunk hole is formed in an eccentric position of the second convex connecting rod, so that the second adjusting screw penetrates through the second sunk holes and extends into the second eccentric holes to adjust a distance between one of the plurality of anti-bounce rollers and the corresponding slide roller, and wherein the second adjusting screw is provided with a second external threaded section to penetrate into the second sunk hole of the second eccentric roller and extend into the second eccentric holes, so that the second adjusting screw penetrates into the hole of the convex connector and is screwed and fixed at rear ends of the screw hole of the fixing part, and wherein the second sealing sleeve is provided with a second internal threaded hole facing the second screw connector of the second eccentric roller, so that the second screw connector is screwed in the second internal threaded hole.

4. The anti-derailing device for the sliding door according to claim 3, wherein an outer diameter of the straight rod body of the fixing part is smaller than an outer diameter of the external member.

5. The anti-derailing device for the sliding door according to claim 1, wherein the first holding base of each of the plurality of rail supporting bases is provided with an abutting body facing the positioning part to abut against the fixed door, and a holding surface extending from the abutting body towards the second holding base, aside of the holding surface is formed with a first concave arc edge for arranging and positioning the rail, and the holding surface is provided with a hole located near a bottom end and facing the second holding base, and wherein a side of the second holding base facing the first holding base is formed with a bearing surface, and a height of the bearing surface is the same height as a height of the holding surface, and a second concave arc edge is formed by being curved towards the first holding base and fits the first concave arc edge to hold and position the rail, and a side of the second holding base away from the first holding base is provided with a ring groove for a ring gasket to fit in, and a bottom of the second holding base facing the ring groove is provided with a positioning hole corresponding to the hole, and a bottom of the ring gasket is provided with a notch corresponding to the positioning hole, and wherein the fixing member penetrates into the positioning holes of the second holding base and extends into the hole of the first holding base to be positioned, and a cushion is disposed at an outer side of the positioning hole to shield the fixing member, and wherein the positioning part is provided with a locking member facing the holding part and is locked with the holding part.

6. The anti-derailing device for the sliding door according to claim 5, wherein a height of the second holding base is the same as a height of the abutting body of the first holding base.

7. The anti-derailing device for the sliding door according to claim 5, wherein a highest point of the first concave arc edge of the first holding base is higher than a central point of first concave arc edge, and a highest point of the second concave arc edge of the second holding base is higher than a central point of the second concave arc edge.

8. The anti-derailing device for the sliding door according to claim 5, wherein a depth of the groove at the bottom of the first holding base exceeds the bottom of the first concave arc edge of the first holding base.

* * * * *